United States Patent [19]

Ariyama et al.

[11] 4,294,535

[45] Oct. 13, 1981

[54] ELECTROSTATIC COPYING APPARATUS

[75] Inventors: Kenzo Ariyama; Syozo Miyawaki; Takashi Murakami, all of Tokyo, Japan

[73] Assignee: Ricoh Company, Ltd., Tokyo, Japan

[21] Appl. No.: 114,016

[22] Filed: Jan. 21, 1980

[30] Foreign Application Priority Data

Jan. 30, 1979 [JP] Japan ..... 54-9412

[51] Int. Cl.[3] ..... G03G 15/00

[52] U.S. Cl. ..... 355/14 SH; 271/171; 355/3 SH; 355/14 TR

[58] Field of Search ..... 355/3 R, 3 SH, 3 TR, 355/14 R, 14 SH, 14 TR, 75; 271/171, 238, 240

[56] References Cited

U.S. PATENT DOCUMENTS 3,647,207 3/1972 McPherson ..... 271/171 X
3,689,143 9/1972 Case et al. ..... 355/3 R
3,957,366 5/1976 Taylor et al. ..... 355/3 R
4,129,377 12/1978 Miyamoto et al. ..... 355/14 SH

*Primary Examiner*—Fred L. Braun
*Attorney, Agent, or Firm*—David G. Alexander

[57] ABSTRACT

In an electrostatic copying machine (21) having an automatic document feed system (23), a document (28) is fed onto a platen (26) for scanning in a first direction (36) and a copy sheet (64) is fed into toner image transferring engagement with a photoconductive drum (27) in a second direction (84) which is perpendicular to the first direction (36). The document (28) is aligned with a center of a document feed path (34) regardless of the width of the document (28). The timing at which the copy sheet feed begins is controlled in accordance with the sensed width of the document (28) in such a manner that a leading edge of the copy sheet (64) aligns with a leading edge of a toner image on the drum (27).

7 Claims, 11 Drawing Figures

ELECTROSTATIC COPYING APPARATUS

BACKGROUND OF THE INVENTION

The present invention relates to an electrostatic copying apparatus having an automatic document feed (ADF) system. More specifically, an original document is fed onto a glass platen for imaging in a first direction in such a manner that the center of the document is aligned with a center line of the document feed path regardless of the width of the document. The document is scanned perpendicular to the first direction to form an electrostatic image on a photoconductive drum. The electrostatic image is developed to form a toner image. A copy sheet is fed in a second direction which is perpendicular to the first direction into engagement with the drum to transfer the toner image to the copy sheet. The toner image is fixed to the copy sheet to provide a permanent reproduction of the original document.

It is desired to be able to copy documents having different widths (perpendicular to the center line of the document feed path). Assuming that the apparatus is arranged to copy a document having a maximum width, the leading edge of the copy sheet will align with the leading edge of the toner image on the drum during toner image transfer. However, if a document having a width which is $2\Delta S$ smaller than the maximum width is copied without modification of the system, the leading edge of the copy sheet will not align with the leading edge of the toner image on the drum. More specifically, there will be a blank space having a width of $\Delta S$ extending from the leading edge of the copy sheet to the leading edge of the toner image on the copy sheet. Assuming that the width of the copy sheet is the same as the width of the document, a portion of the trailing edge of the toner image having a width of $\Delta S$ will not be transferred to the copy sheet but will remain on the drum. The reasons for this are that the center of the document is aligned with the center line of the document feed path and that the imaging and transfer feed operations are performed perpendicular to the document feed operation.

One method of overcoming this problem is to vary the feed rate of the copy sheet so that the feed rate or speed is lower for small documents. However, this requires a variable transmission or other speed variation means which adds to the cost and complexity of the apparatus.

Another expedient is to align a side edge of the document with an edge of the platen. While this will align the leading edges of the copy sheet and toner image, it will produce skew feed of the document where feed rollers are provided along the center of the document feed path. Although the feed rollers may be moved transversely to align with the center of the document, a mechanism for providing this function is undesirably complex and costly.

SUMMARY OF THE INVENTION

An electrostatic copying apparatus embodying the present invention includes a transparent document support platen, document feed means for feeding an original document along a document feed path onto the platen in a first direction, a photoconductive member, imaging means for radiating a light image of the document onto the photoconductive member to form an electrostatic image, developing means for developing the electrostatic image to produce a toner image and transfer means for feeding a copy sheet into engagement with the photoconductive member in a second direction which is perpendicular to the first direction to transfer the toner image to the copy sheet, and is characterized by comprising document support means for supporting the document prior to feeding by the document feed means such that a center line of the document is aligned with a center line of the document feed path, sensor means for sensing a width of the document perpendicular to the document feed path, and sheet feed timing means for controlling the transfer means to begin feeding the copy sheet to the photoconductive member at a timing corresponding to a predetermined function of the width of the document such that a leading edge of the copy sheet aligns with a leading edge of the toner image on the photoconductive member.

In an electrostatic copying machine having an automatic document feed system, a document is fed onto a platen for scanning in a first direction and a copy sheet is fed into toner image transferring engagement with a photoconductive drum in a second direction which is perpendicular to the first direction. The document is aligned with a center of a document feed path regardless of the width of the document. The timing at which the copy sheet feed begins is controlled in accordance with the sensed width of the document in such a manner that a leading edge of the copy sheet aligns with a leading edge of a toner image on the drum.

It is an object of the present invention to provide an electrostatic copying apparatus in which documents and copy sheets are fed in mutually orthogonal directions comprising improved means for automatically aligning leading edges of the copy sheet and a toner image on a drum.

It is another object of the present invention to provide an electrostatic copying apparatus which is reliable in operation yet simplified over the prior art and economical to manufacture on a commercial production basis.

It is another object of the present invention to provide a generally improved electrostatic copying apparatus.

Other objects, together with the foregoing, are attained in the embodiments described in the following description and illustrated in the accompanying drawing.

DESCRIPTION OF THE PREFERRED EMBODIMENTS

While the electrostatic copying apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
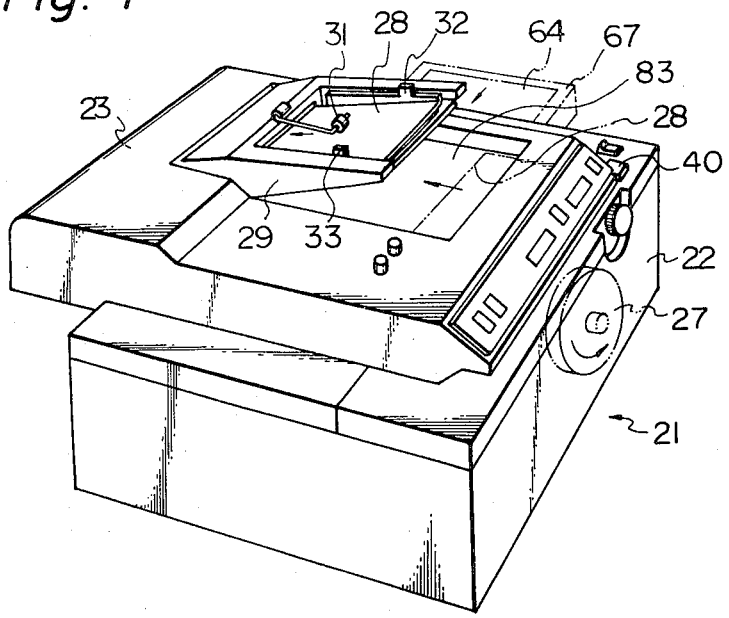
FIG. 1 is an overall perspective view of an electrostatic copying apparatus embodying the present invention.

Referring now to the drawing, an electrostatic copying apparatus embodying the present invention is generally designated by the reference numeral 21 and comprises a housing 22. An automatic document feed device (ADF) 23 is mounted on top of the housing 22 and may be rocked about a shaft 24 (FIG. 3) from an operative position for automatic document feed shown in FIGS. 1 to 3 to an inoperative position shown in FIG. 5. A glass transparent platen 26 defines part of the upper surface of the housing 22. A photoconductive drum 27 is rotated below the platen 26 at constant speed.

In operation, a stack of original documents 28 are placed in an upper tray or support 29 and held down by a roller 31. A pair of side guides 32 and 33 are spaced on opposite sides of a center line 34 (FIG. 4) of a document feed path. The guides 32 and 33 are movable toward and away from each other and connected together by a linkage (not shown) in such a manner as to be always spaced equally from the center line 34. The guides 32 and 33 are manually moved toward each other until they abut against the respective side edges of the documents 28. In this manner, the centers of the documents 28 are aligned with the center line 34.

Figure 3:
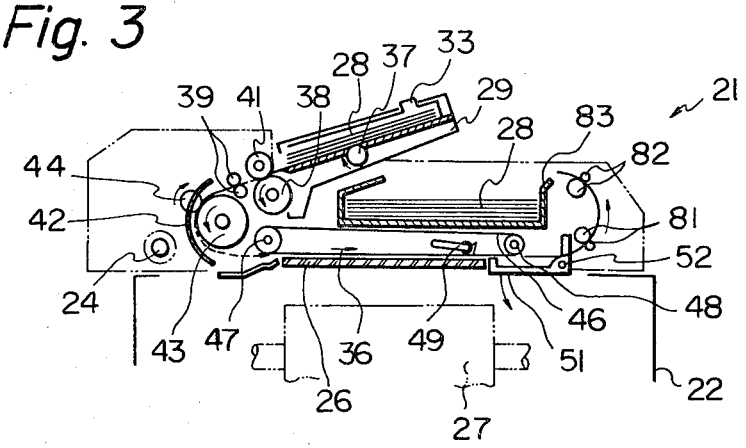
FIG. 3 is a transverse sectional view of the apparatus.

Upon depression of a print switch 40, the lowermost document 28 is fed from the stack onto the platen 26 in a first direction as indicated by an arrow 36 in FIG. 3. More specifically, the lowermost document 28 is moved by a feed roller 37 to a feed roller 38 which feeds the document 28 into the bite of feed rollers 39. Further illustrated is a separation or friction roller 41 which is either held stationary or rotated counterclockwise to urge the document 28 back toward the tray 29. This prevents feeding of more than one document 28. The document 28 is fed from the rollers 39 around a guide 42 which reverses the direction of movement onto the platen 26. A turning roller 43 cooperates with an idler roller 44 in transporting the document 28 around the guide 42. The document 28 is moved rightwardly (in the first direction) across the platen 26 as viewed in FIG. 3 by a conveyor belt 46 which is trained around rollers 47 and 48 and rotated counterclockwise. A presser roller 49 presses the belt 46 against the document 28 and platen 26 to facilitate document feed.

A pawl 51 is rotatably mounted on a shaft 52 and movable thereby above and below the surface of the platen 26. As the document 28 approaches the pawl 51, the pawl 51 is rotated clockwise so as to protrude above the surface of the platen 26. Thus, the leading edge of the document 28 will abut against the pawl 51 and be held stationary on the platen 26. The shaft 52 is rotated by a solenoid (not shown).

Figure 2:
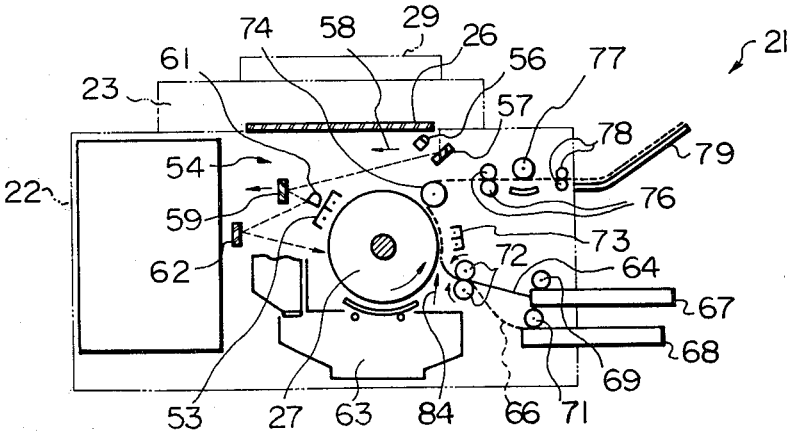
FIG. 2 is a longitudinal sectional view of the present apparatus.

As best seen in FIG. 2, the drum 27 is electrostatically charged by a corona charger 53. Then, a light image of the document 28 is radiated onto the drum 27 by an optical imaging means 54 to form an electrostatic image of the document 28 on the drum 27 through localized photoconduction. The imaging means 54 comprises a light source 56 which illuminates the document 28 from below. The light source 56 is moved together with a mirror 57 as indicated by an arrow 58 at the same surface speed as the drum 27 (for unity magnification) to reflect a light image of a linear portion of the document 28 to a mirror 59. The mirror 59 is also moved leftwardly but at one half the surface speed of the drum 27.

The light image is reflected from the mirror 59 to converging lens 61 having a reflecting rear surface. The lens 61 converges the image and reflects it to a mirror 62 which reflects the image onto the drum 27 in such a manner that the image is focussed on the drum 27. The lens 61 and mirror 62 are stationary. In this manner, the document 28 is scanned and an electrostatic image thereof formed on the drum 27.

A developing unit 63 applies toner to the drum 27 to develop the electrostatic image into a toner image. Copy sheets 64 and 66 of different sizes are stacked in cassettes 67 and 68 respectively. Feed rollers 69 and 71 are selectively rotated to feed the top sheet 64 or 66 into the bite of register rollers 72. It will be assumed for purposes of description that the sheet 64 is selected to be fed.

The register rollers 72 are initially held stationary so that the leading edge of the sheet 64 is held in the bite thereof. At a predetermined timing, the register rollers 72 are rotated to feed the sheet 64 into engagement with the drum 27. The timing is selected so that the leading edge of the sheet 64 aligns with the leading edge of the toner image on the drum 27. A transfer charger 73 applies an electrostatic charge to the back of the sheet 64 to transfer the toner image thereto. The sheet 64 is fed at the same surface speed as the drum 27 and separated therefrom at a roller 74 which feeds the sheet 64 in conjunction with feed rollers 76 to a fixing unit 77. The fixing unit 77 fixes the toner image to the sheet 64 using heat, pressure or a combination thereof. Feed rollers 78 feed the finished copy from the fixing unit 77 into a tray 79 for use. Although not illustrated, a cleaning unit discharges the drum 27 and removes any residual toner therefrom prior to recharging by the charging unit 53.

After the scanning operation is completed, the pawl 51 is lowered and the document 28 fed into a tray 83 by feed rollers 81 and 82. It will be noted that the sheet 64 is fed into engagement with the drum 27 in a second direction which is indicated by an arrow 84 in FIG. 2.

It will be noted that the first direction of the arrow 36 is perpendicular to the second direction of the arrow 84. The arrow 36 lies in the plane of FIG. 3 which is perpendicular to the plane of FIG. 2 in which the arrow 84 lies. The drum 27 rotates parallel to the plane of FIG. 2 with the axis thereof being parallel to the plane of FIG. 3. As best seen in the exploded view of FIG. 4, the document 28 is fed in the first direction as indicated by the arrow 36 and scanned in a direction perpendicular to the first direction as indicated by the arrow 58.

Figure 4:
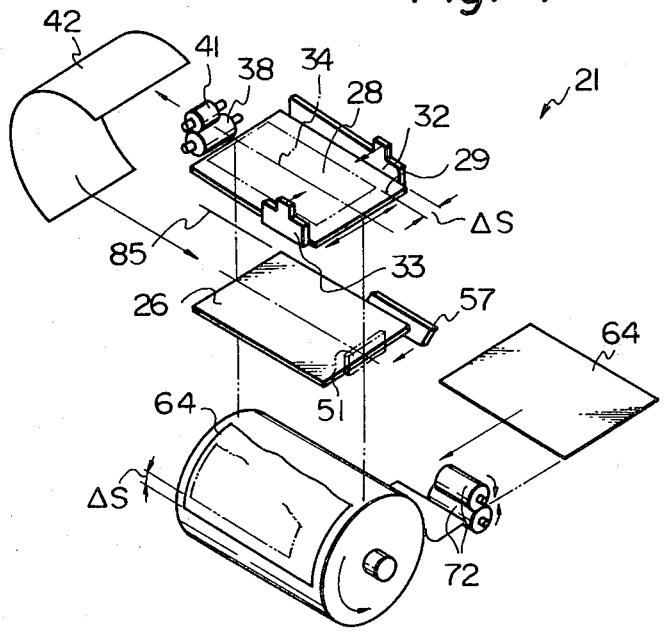
FIG. 4 is an exploded perspective view of the apparatus.
Figure 5:
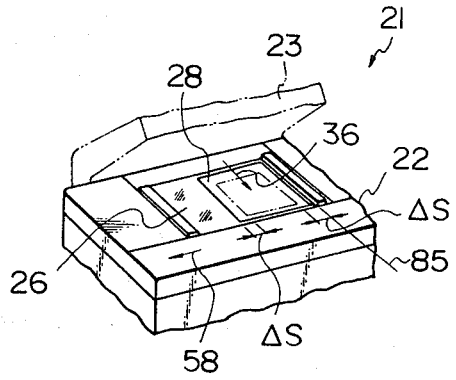
FIG. 5 is a perspective view illustrating document positioning on a platen of the apparatus.
Figure 6:
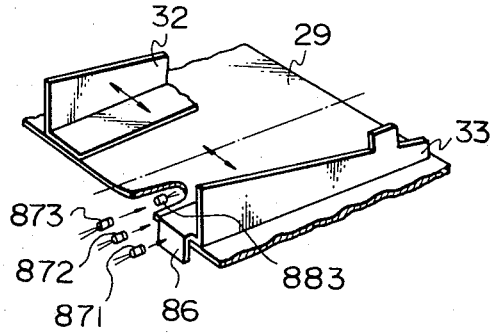
FIG. 6 is a perspective view illustrating a document support and sensor means of the apparatus.
Figure 7:
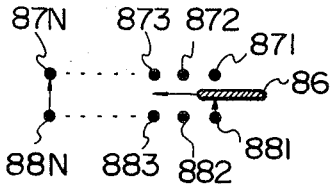
FIG. 7 is a diagram illustrating the operation of the sensor means.

If the apparatus 21 is set to copy a document 28 having maximum width (perpendicular to the center line 34), the leading edge of the sheet 64 will align with the leading edge of the toner image on the drum 27. However, if a smaller document is copied which has a width of, for example, $2\Delta S$ smaller than the width of the widest document, the leading edge of the sheet 64 will not align with the leading edge of the toner image on the drum 27. As illustrated in FIGS. 4 and 5, a blank area having a width of ΔS will be formed on the leading edge portion of the sheet 64. Also, although not illustrated, a portion of the toner image having a width of ΔS will not be transferred to the trailing edge portion of the sheet 64. This is because the center of the document 28 is aligned with the center line 34 of the document feed path and also because the scanning direction is perpendicular to the document feed direction.

As shown in FIGS. 4 and 5, a document 28 having maximum width will have one edge aligned with an edge 85 of the platen 26 which constitutes the first scan position. Where the document 28 has a width which is 2ΔS smaller than the maximum width, the respective edge thereof will be spaced from the edge 85 by a distance ΔS. Thus, the leading edge of the light image and thereby the toner image will be spaced by the distance ΔS from the leading edge of the copy sheet 64.

This problem is overcome in accordance with the present invention by automatically sensing the width of the document 28 and delaying the feeding of the sheet 64 by a length of time corresponding to the difference between the width of the maximum sized document and the document 28 which is actually being copied. Where the difference is 2ΔS, the delay is equal to ΔS (one half the difference) divided by the feed speed of the sheet 64. In this manner, the leading edge of the sheet 64 will align with the leading edge of the toner image on the drum 27.

Referring now to FIGS. 6 to 9, the guide 33 is formed with a projection 86 which acts as an occluder. A plurality of light sources 87l to 87N are disposed in a row parallel to the direction of movement of the guide 33. A plurality of photosensors 88l to 88N are disposed on the other side of the occluder 86 opposite the light sources 87l to 87N respectively. In this manner, various photosensors 88l to 88N will be blocked by the occluder 86 depending on the position of the guide 33 and thereby the width of the document 28. Where the document 28 has the maximum width, none of the photosensors 88l to 88N will be blocked by the occluder 86 and will produce low outputs. Where the document 28 has minimum width, all of the photosensors 88l to 88N will be blocked and will produce high outputs.

Figure 8:
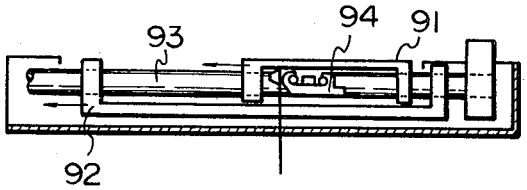
FIG. 8 is a fragmentary view of an imaging means of the apparatus.
Figure 9:
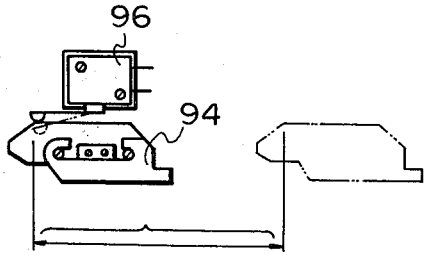
FIG. 9 is a fragmentary view of another portion of the imaging means.

As best seen in FIGS. 8 and 9, sliders 91 and 92 are slidable on a shaft 93. The slider 91 carries the light source 56 and mirror 57. The slider 92 carries the mirror 59. A drive mechanism (not shown) drives the sliders 91 and 92 at a 2:1 speed ratio. The slider 91 also carries a cam 94 which actuates a microswitch 96 when the slider 91 reaches a particular position.

The position at which the cam 94 actuates the microswitch 96 is selected to be at a distance D from a home or scan start position illustrated in phantom line. The time required for the cam 94 to move the distance D has a value T and is selected so that if the feeding of the sheet 64 is started when the microswitch 96 is actuated (produces a signal), the leading edge of the sheet 64 will align with the leading edge of the toner image on the drum 27 where the document 28 has maximum width. Typically, although not illustrated, a clutch is provided between a motor and the register rollers 72 which is engaged for feeding the sheet 64 upon actuation of the microswitch 96 by the cam 94 in the case of a maximum width document 28. Where the document 28 has less than the maximum width as determined by the photosensors 88l to 88N, a delay ΔT will be added to the time T. In other words, feeding of the sheet 64 will begin (the clutch for the register rollers 72 will be engaged) at a time T+ΔT after the cam 94 leaves the home position. The delay ΔT is equal to one half the difference between the maximum document width and the sensed document width divided by the feed speed of the sheet 64.

Figure 10:
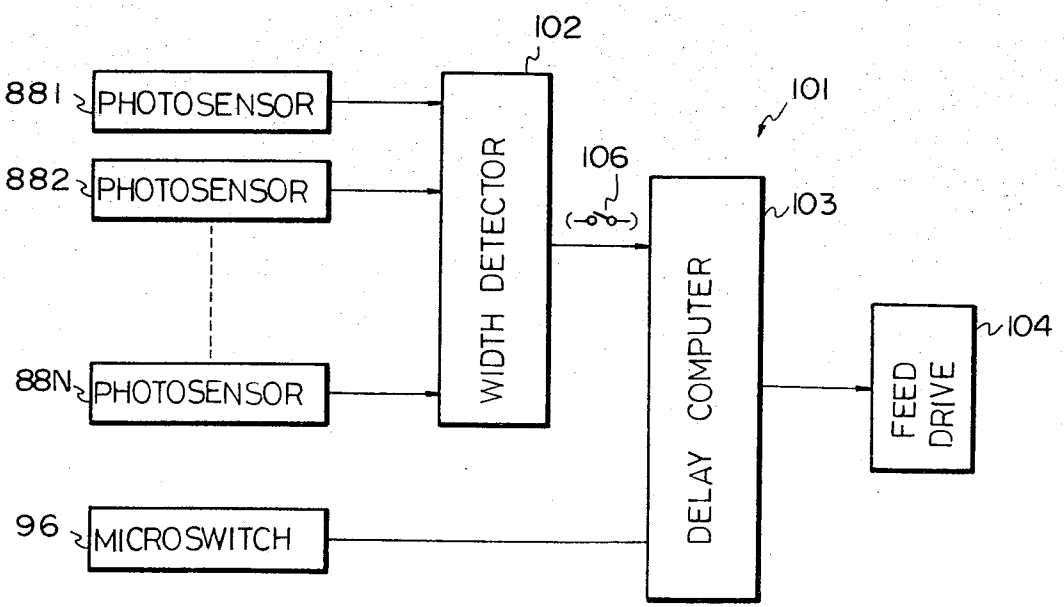
FIG. 10 is a block diagram of a sheet feed timing means of the apparatus.

Referring now to FIG. 10, a sheet feed timing control unit is designated as 101 and comprises a width detector 102 for detecting or determining the width of the document 28 based on the outputs of the photosensors 88l to 88N. The output of the width detector 102 and microswitch 96 are applied to a delay computer 103 which computes the delay ΔT as indicated above. The computer 103 produces an output signal after the delay ΔT upon actuation of the microswitch 96 which is fed to a feed drive unit 104 which begins the feeding of the sheet 64 in response thereto. A switch 106 is provided between the width detector 102 and delay computer 103 which is actuated when the document feed device 23 is elevated to its upper position to allow a large or bulky document such as a map or book to be manually placed on the platen 26. In such a case, an edge of the document is aligned with the edge 85 and the delay ΔT is set to zero as in the case of a maximum width document.

Figure 11:
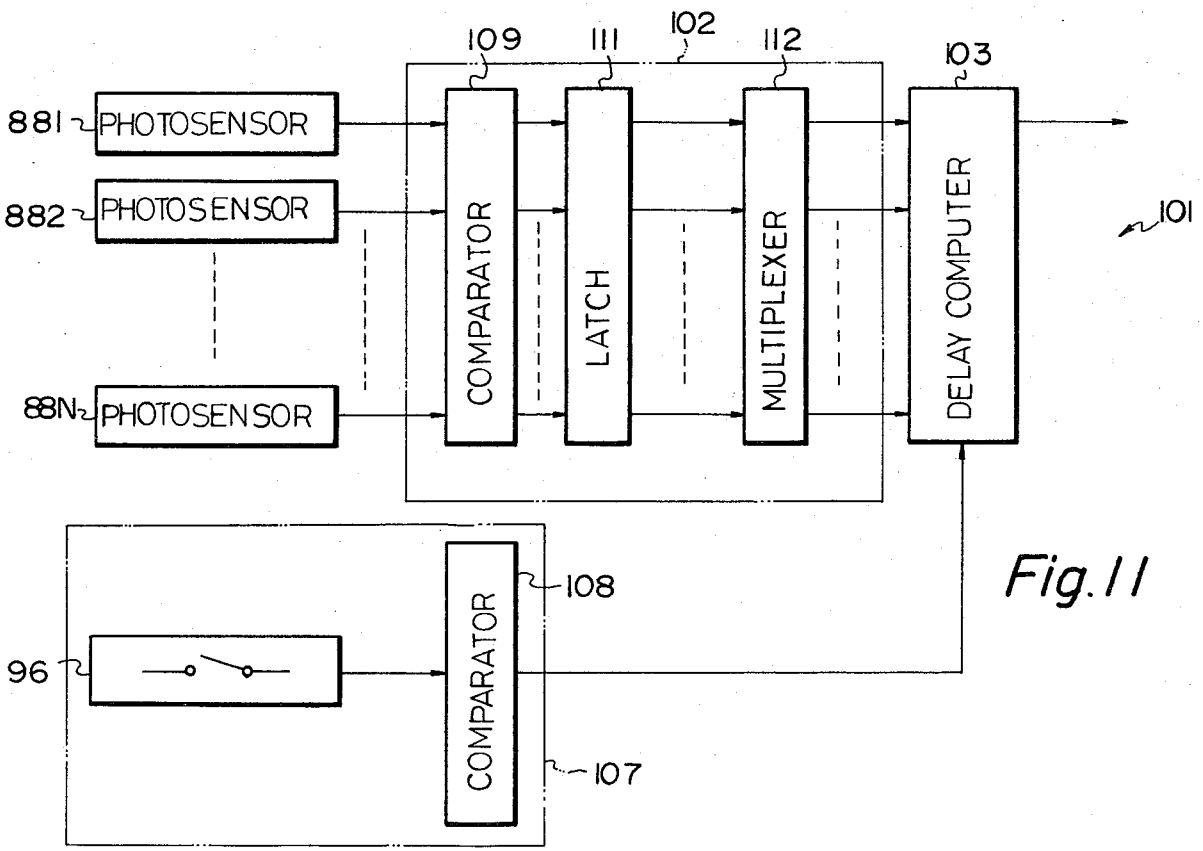
FIG. 11 is a more detailed block diagram of the sheet feed timing means.

The timing control unit 101 is shown in more detail in FIG. 11. The microswitch 96 is part of a start signal generator 107 which comprises a comparator 108 connected between the microswitch 96 and the delay computer 103. The comparator 108 produces a high output when the microswitch 96 is closed.

The width detector 102 comprises a comparator 109 connected to the outputs of the photosensors 88l to 88N and a latch 111 connected to the output of the comparator 109. The comparator 109 produces a high output on a separate line corresponding to each respective photosensor 88l to 88N which is blocked by the occluder 86. The signals are latched by the latch 111. A multiplexer 112 is connected to the output of the latch 111 and produces an output signal having a discrete magnitude depending on the number of photosensors 88l to 88N blocked by the occluder 86. When none of the photosensors 88l to 88N are blocked, indicating a maximum width document, the multiplexer 112 produces a zero output. Conversely, when all of the photosensors 88l to 88N produce high outputs indicating a minimum width document, the multiplexer 112 produces a maximum output. The output of the multiplexer 112 progressively increases as more of the photosensors 88l to 88N are blocked by the occluder 86 indicating greater document width. The delay computer 103 computes the delay ΔT which is proportional to the output of the multiplexer 112. Typically, the delay computer 103 will comprise a monostable multivibrator (not shown) having a pulse width output proportional to applied voltage from the multiplexer 112. The pulse from the multivibrator inhibits the high signal from the comparator 108 for the pulse width period which corresponds to the delay ΔT.

In summary, it will be seen that the present invention overcomes the drawbacks of the prior art and provides an improved electrostatic copying apparatus which ensures proper toner image register or alignment regardless of document width. Various modifications will become possible for those skilled in the art after receiving the teachings of the present disclosure without departing from scope thereof. For example, the photosensors 88l to 88N may be replaced by alternative sensor means such as microswitches or a potentiometer which produces an output voltage proportional to the position of the guide 33. The width of the document may be sensed directly by means of photosensors or the like disposed in the docment feed path rather than indirectly by sensing the position of the guide 33. Naturally, the microswitch 96 may be replaced by a photosensor or alternative sensing means.

What is claimed is:

1. An electrostatic copying apparatus including a transparent document support platen, document feed means for feeding an original document along a document feed path onto the platen in a first direction, a photoconductive member, imaging means for radiating a light image of the document onto the photoconductive member to form an electrostatic image, developing means for developing the electrostatic image to produce a toner image and transfer means for feeding a copy sheet into engagement with the photoconductive member in a second direction which is perpendicular to the first direction to transfer the toner image to the copy sheet, characterized by comprising:

document support means for supporting the document prior to feeding by the document feed means such that a center of the document is aligned with a center line of the document feed path;

sensor means for sensing a width of the document perpendicular to the document feed path;

sheet feed timing means for controlling the transfer means to begin feeding the copy sheet to the photoconductive member at a timing corresponding to a predetermined function of the width of the document such that a leading edge of the copy sheet aligns with a leading edge of the toner image on the photoconductive member.

2. An apparatus as in claim 1, in which the document support means comprises a pair of guide members movable toward and away from each other at equal spacing from the center line of the document feed path, the sensor means being constructed to sense a position of one of the guide members.

3. An apparatus as in claim 1, in which the sheet feed timing means is constructed to compute said timing as the sum of a minimum timing corresponding to a document having a maximum width plus a delay corresponding to a difference between the sensed width of the document and the maximum width.

4. An apparatus as in claim 3, in which said delay is equal to one half of said difference divided by a sheet feed speed of the copy sheet.

5. An apparatus as in claim 1, in which the imaging means is movable relative to the platen for scanning the document, the sheet feed timing means comprising means for generating a signal when the imaging means is in a predetermined position relative to the platen during said movement and means for controlling the transfer means to begin feeding the copy sheet at said timing which corresponds to a predetermined length of time after generation of said signal.

6. An apparatus as in claim 1, in which the photoconductive member has an endless surface which rotates parallel to a plane which is perpendicular to the first direction, the second direction being parallel to said plane.

7. An apparatus as in claim 6, in which the photoconductive member is a drum which is rotatable about an axis parallel to the first direction.

* * * * *